US008925647B2

(12) United States Patent
Humphreys

(10) Patent No.: US 8,925,647 B2
(45) Date of Patent: Jan. 6, 2015

(54) TRIPLE ACTIVITY DRILLING SHIP

(75) Inventor: Gavin Humphreys, Aberdeen (GB)

(73) Assignee: Stena Drilling Ltd., Aberdeen (GB)

( * ) Notice: Subject to any disclaimer, the term of this patent is extended or adjusted under 35 U.S.C. 154(b) by 2581 days.

(21) Appl. No.: 11/479,023

(22) Filed: Jun. 30, 2006

(65) Prior Publication Data

US 2008/0000685 A1 Jan. 3, 2008

(51) Int. Cl.
*E21B 19/00* (2006.01)
*E21B 15/02* (2006.01)

(52) U.S. Cl.
CPC ..... *E21B 15/02* (2013.01); *E21B 19/004* (2013.01); *E21B 19/002* (2013.01)
USPC ..... 175/5; 175/8; 166/358

(58) Field of Classification Search
CPC ..... E21B 19/002; E21B 19/004
USPC ..... 166/358, 359, 341, 380; 175/2, 8, 10, 175/52, 85, 5; 414/22.68
See application file for complete search history.

(56) References Cited

U.S. PATENT DOCUMENTS

| | | | | |
|---|---|---|---|---|
| 3,895,677 | A | 7/1975 | Bokenkamp | |
| 4,108,318 | A * | 8/1978 | Rode et al. | 414/22.51 |
| 4,117,941 | A * | 10/1978 | McCleskey et al. | 414/22.63 |
| 4,208,158 | A * | 6/1980 | Davies et al. | 414/22.68 |
| 4,227,831 | A * | 10/1980 | Evans | 405/196 |
| 4,315,709 | A * | 2/1982 | Gulick | 414/22.57 |
| 4,367,796 | A * | 1/1983 | Bolding | 166/341 |
| 4,470,468 | A * | 9/1984 | Phares | 175/7 |
| 4,716,972 | A * | 1/1988 | Makinen et al. | 175/8 |
| 4,725,179 | A * | 2/1988 | Woolslayer et al. | 414/22.65 |
| 4,819,730 | A * | 4/1989 | Williford et al. | 166/355 |
| 4,899,682 | A * | 2/1990 | Pouget et al. | 114/264 |
| 5,647,443 | A * | 7/1997 | Broeder | 175/5 |
| 5,865,260 | A * | 2/1999 | Jackson et al. | 175/5 |
| 6,056,071 | A | 5/2000 | Scott et al. | |
| 6,068,069 | A | 5/2000 | Scott et al. | 175/5 |
| 6,217,258 | B1 * | 4/2001 | Yamamoto et al. | 405/201 |
| 6,321,675 | B1 * | 11/2001 | Dybdahl et al. | 114/264 |
| 6,766,860 | B2 * | 7/2004 | Archibald et al. | 166/341 |
| 7,451,821 | B2 * | 11/2008 | Rashid et al. | 166/358 |
| 2003/0159853 | A1 | 8/2003 | Archibald et al. | |

FOREIGN PATENT DOCUMENTS

| | | |
|---|---|---|
| WO | WO 01/07812 | 2/2001 |
| WO | WO 2005/118999 | 12/2005 |

* cited by examiner

*Primary Examiner* — Matthew Buck
(74) *Attorney, Agent, or Firm* — Trop, Pruner & Hu, P.C.

(57) ABSTRACT

A triple activity drilling ship may be provided with two separate drilling centers, each including drilling apparatus. In addition, a trolley that is capable of supporting tubulars may be positioned between a first position within one of said drilling centers and a second position outside that drilling center. As a result, the trolley may be used to hold assembled tubulars while other activities are ongoing in one or more of the drilling centers.

9 Claims, 5 Drawing Sheets

TRIPLE ACTIVITY DRILLING SHIP

BACKGROUND

This invention relates generally to offshore drilling operations.

Offshore drilling operations may be implemented with a variety of different platforms which may be secured to the seabed floor. These platforms may be effective at shallower depths. At greater depths, such as depths greater than 5000 feet, it is generally desirable to use ships or semi-submersible rigs to conduct such deep water drilling operations.

These ships or rigs may be precisely positioned at a desired location so that the drilling equipment may be operated to precisely drill wells at desired locations. The ship or rig may be maintained in position under dynamic positioning even in extreme seas. As used herein, a "ship" is a floating platform capable of propulsion on its own or by being pushed, pulled or towed. It includes semi-submersible rigs and self-propelled vessels.

As a result, a number of exploration wells may be drilled, one after the other, in a deepwater offshore environment, such as the outer continental shelf of the United States, Africa, Asia, or Western Europe. However, the large number of operations that must be performed when successively drilling a number of exploration wells, even in the same area, may be extremely time consuming because of the complexity of deep water operations.

Conventionally, tubulars must be made up, lowered through extensive sea depths to the seabed floor, used to drill the seabed floor, and then withdrawn to be replaced by other tubulars. As used herein, "tubulars" refers to piping, conduits, conductors, casing, drill strings, and risers. In addition, marine risers must extend ultimately from the ship to the seabed floor and blowout preventers may ultimately be run and installed on the seabed floor for well control reasons. Assembling, positioning, and removing these disparate tubulars generally involve operations that take extensive time periods. The time needed to extend a tubular through 5000 or greater feet of water results in some delay. The time needed to make up tubulars results in additional delay.

With a conventional ship having a single drilling platform, it is impossible to perform multiple operations in parallel. Thus, the time periods needed to complete each well may be relatively long. Since, generally, these drilling ships are operated on a rental basis, the longer that it takes to drill the well, the more expensive is the resulting well.

So called dual activity drilling ships are known. In these ships, a pair of derricks may be provided on the ship which provide a structural support for underlying drilling tubulars. The dual derricks may be operated in some degree in parallel. For example, while one operation is occurring on one derrick, other operations may be implemented on another derrick. While such approaches may result in some time savings, there are still some deficiencies in such dual activity approaches.

Thus, there is a need for even faster ways to drill deep water wells.

DETAILED DESCRIPTION

Figure 1:
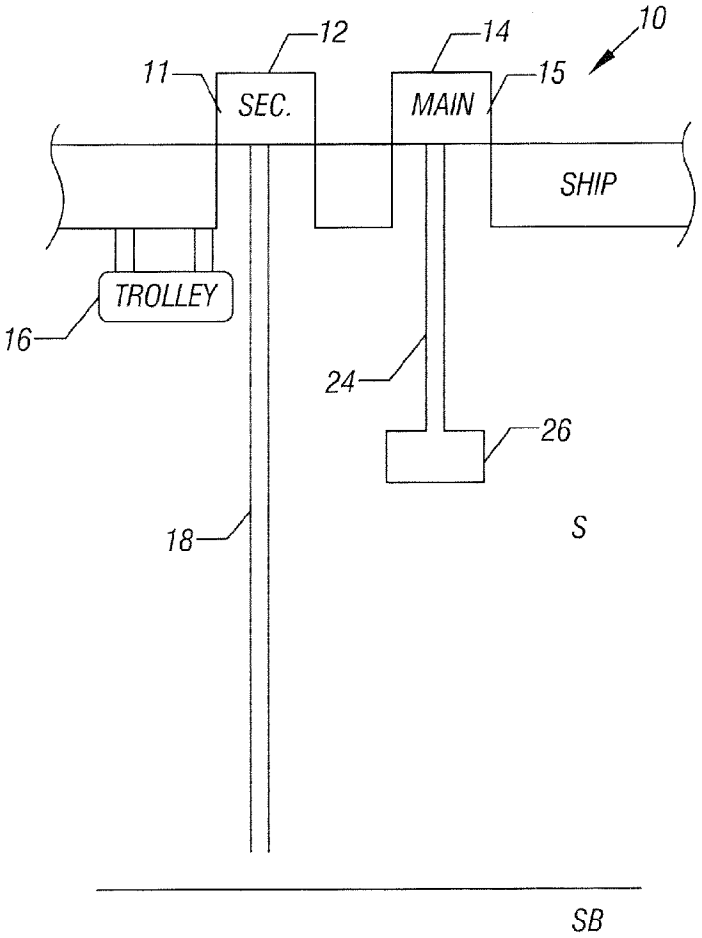
FIG. 1 is a partial, schematic depiction of a drill ship in position at an offshore drill site at an early stage in the well completion process according to one embodiment of the present invention.

Referring to FIG. 1, a triple activity drilling ship 10 may be a ship capable of drilling operations in deep and ultra-deep water. The ship 10 may also be a semi-submersible rig as well. The ship may be equipped with conventional dynamic positioning controls which enable the ship to be precisely positioned at a precisely determined location. Moreover, the ship may be held precisely in position during drilling operations pursuant to computer control.

Prior to arriving on the drilling site, tubulars may be readied. For example, a blow out preventer and riser may be assembled, skidded, and tested prior to arrival. Likewise, the 20 inch casing may be assembled prior to arrival as well.

Initially, as the ship comes on a drilling site, operations are implemented to precisely orient the ship with respect to the seabed floor. Global positioning satellites and other technology may be utilized for this purpose. Some amount of time is needed, prior to initiation of drilling operations, to precisely position the ship at the desired location. During this time, some drilling preparation activities may be accomplished in accordance with some embodiments of the present invention. Tubulars may be made up and readied for use. For example, a 30 inch conductor may be made up and stowed in appropriate tubular holding facilities prior to being actually run into the sea. Likewise, the blow out preventer and riser may be run during the dynamic positioning.

In some embodiments, a main drilling center 14 and a secondary drilling center 12 may be provided. In some embodiments, the secondary drilling center is adapted for handling lighter tubulars, while the main drilling center is adapted to handle heavier tubulars and drilling the well. In one embodiment, the main and secondary drilling centers may be implemented by hydraulic RAM devices 11 and 15. In other embodiments, derricks or superstructures may be provided. Such derricks or superstructures may provide structural support for the tubulars hung from such derricks.

In contrast, with a hydraulic RAM system, the tubulars may be supported directly on the ship's deck. This avoids the need for expensive, heavy derricks to support the tubulars. However, in some embodiments, even using a hydraulic system, masts or guides may be provided to guide the tubulars when they are in their uphauled positions.

Thus, depending on the nature of the centers 12 and 14, different tubular storage facilities may be utilized. For example, when a derrick system is utilized, the derricks are of sufficient strength that tubulars may be stored by simply leaning them against the insides of the derricks. In other cases, tubular and storage systems, setbacks envelopes, and racks may be provided to hold the assembled or partially assembled tubulars.

Conventional equipment may be used for advancing, running, withdrawing, lifting, or rotating the tubulars to the seabed and ultimately into the seabed floor. In this regard, hoists, top drives, sheaves, draw works, rotary tables, traveling blocks, motion compensators, hydraulic RAMS, or any other known equipment may be utilized. The hydraulic RAM may support tubulars on the deck, but derricks support tubulars from above the deck. The present invention is in no way limited to any particular equipment.

As described above, prior to the point when the ship is precisely positioned, some drilling preparatory activities may be completed. In some embodiments, the tubulars may be in the position shown in FIG. 1 at the time when the ship's positioning operation is finally completed. As will be appreciated by those skilled in the art, in this way, substantial activity may be completed prior to the time that drilling may actually begin. This may substantially reduce the overall amount of time needed to complete a given well.

The ship may include a third activity center in the form of a trip saver trolley 16. In one embodiment, the trolley 16 may be a Christmas tree trolley. However, any moveable, tubular supporting surface that can support tubulars may be utilized in some embodiments. Underslung trip saver trolleys mounted on rollers that roll over a rail or track may be utilized, as well as overslung trolleys that ride on top of a rail or track.

In most embodiments, a trolley rail or track allows the trolley to move from a position displaced to the side of the secondary drilling center 12 to a position under or within the secondary drilling center 12. In this way, tubulars already made up and hung from the trolley 16 may be moved in position for use by the secondary drilling center 12. This ability to pre-hang tubulars from the trolley 16 may result in significant time savings since it allows tubulars to be made up prior to the time when drilling operations are actually ready to begin and the ship has been accurately positioned in some embodiments.

Figure 2:
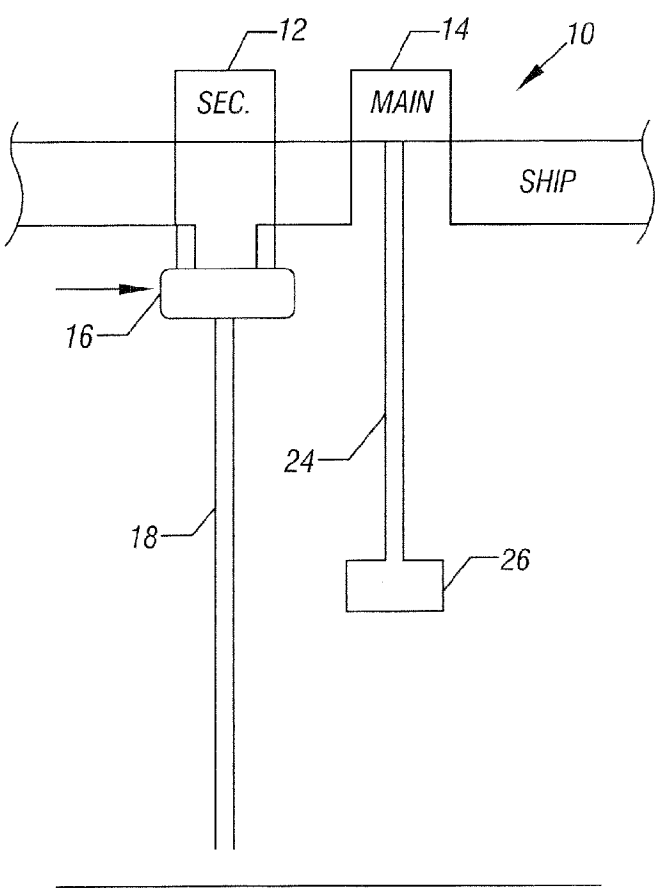
FIG. 2 is a partial, schematic depiction of the drill ship shown in FIG. 1 at a subsequent stage of well completion in accordance with one embodiment of the present invention.

Referring to FIG. 1, initially, a 20 inch casing 18 is made up on the secondary drilling center 12. Then, the trip saver trolley 16, positioned astride the secondary drilling center 12, may be slid into position under the secondary drilling center 12 as indicated in FIG. 2. The trolley 16 may then latch onto the 20 inch casing 18 and slide it to the left in the direction of the arrow shown in FIG. 2.

In some embodiments, the removal of tubulars from one drilling center, such as the drilling center 12, and their securement on the trolley 16 may be done using conventional equipment such as a running tool. In some embodiments, the tubulars may be lifted onto or off of the trolley 16.

Figure 8:
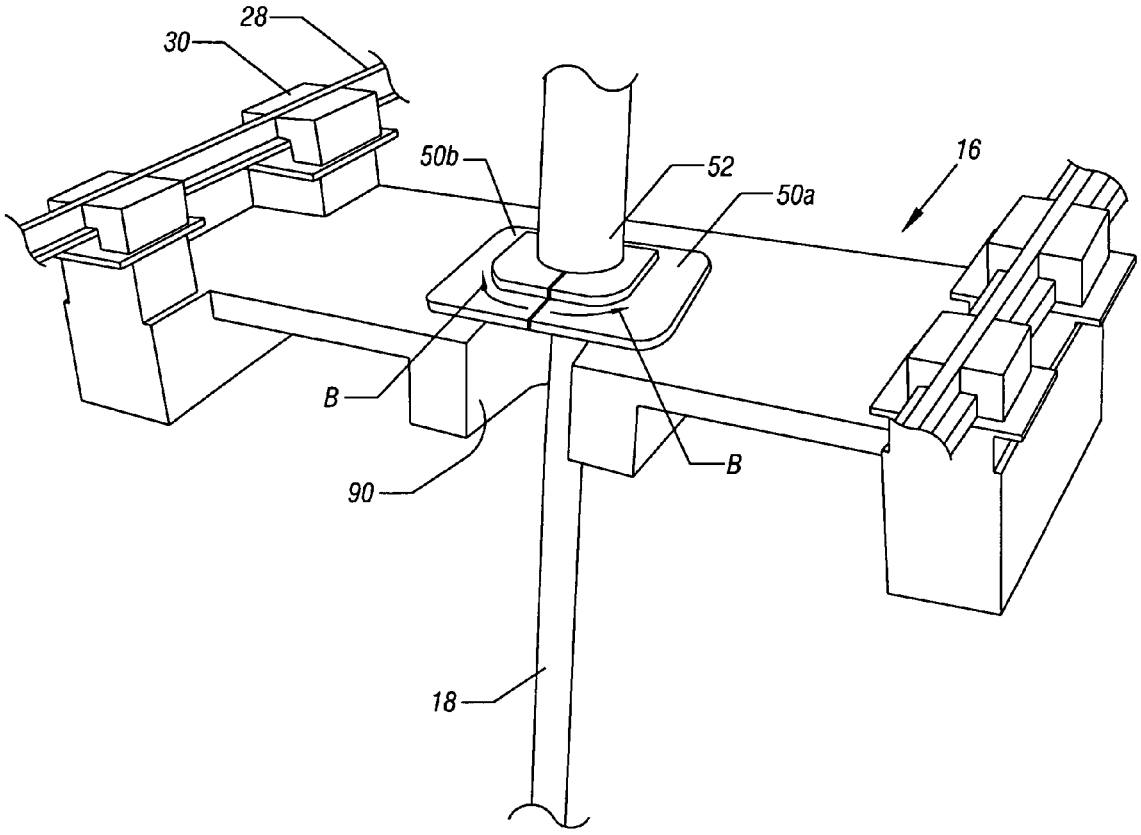
FIG. 8 is a partial, enlarged, perspective view of a trolley and casing hung off in accordance with one embodiment of the present invention.

In some embodiments, the trolley may have an opening 90 which is sized to mate with components of tubulars such as the casing 18 as shown in FIG. 8. For example, the 20 inch casing 18 may have an enlarged element, such as a housing 52, that may be retained atop the trolley 16. The housing 52 may, for example, be used to latch to the blow out preventer.

In one embodiment, a split spherical bearing 50, as shown in FIG. 8, may be utilized. The split spherical bearing 50 may include portions 50*a* and 50*b* that are openable in the directions indicated by the arrows B. In other words, the bearing 50 includes two portions which support the casing 18 on the housing 52. When the bearing 50 is opened, the casing 18 may be lifted from the trolley 16 and moved onto other components. The trolley may include sets of rollers or bearings 30 that slide on a track 28 that extends across the secondary drilling center 12.

Figure 3:
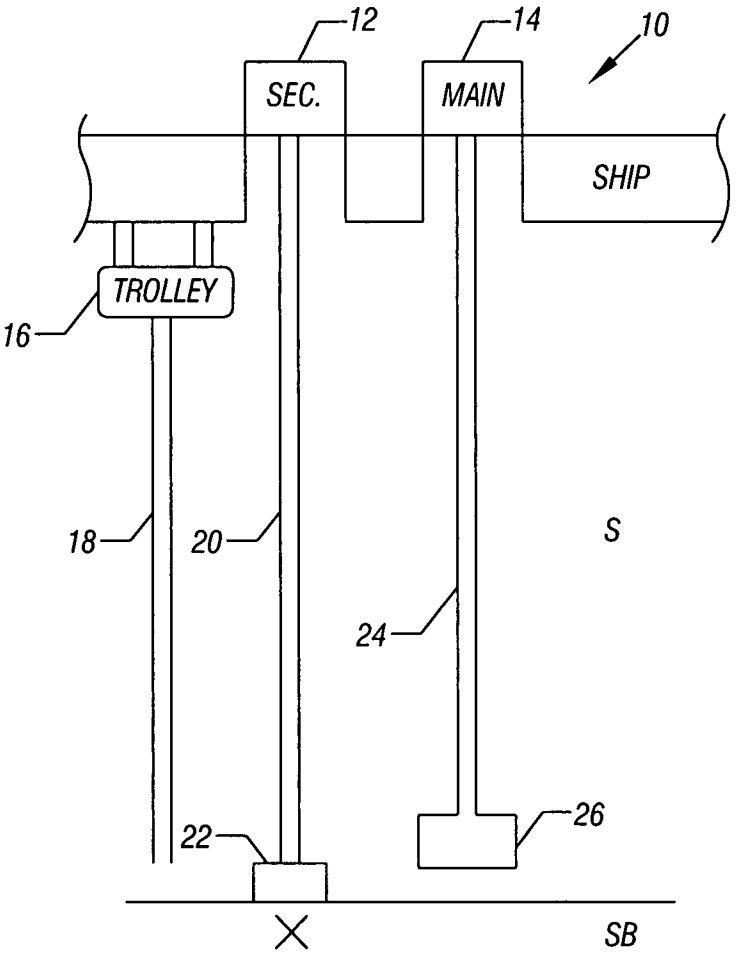
FIG. 3 is a partial, schematic depiction of the drill ship shown in FIG. 1 at a subsequent stage of well completion in accordance with one embodiment of the present invention.

At the instance illustrated in FIG. 3, a 30 inch conductor 22 may have been run down to the seabed floor, perhaps without yet contacting the seabed floor SB. The conductor 22 may be supported on a string 20. This means the 30 inch conductor was already made up with an internal 26 inch drill.

Figure 4:
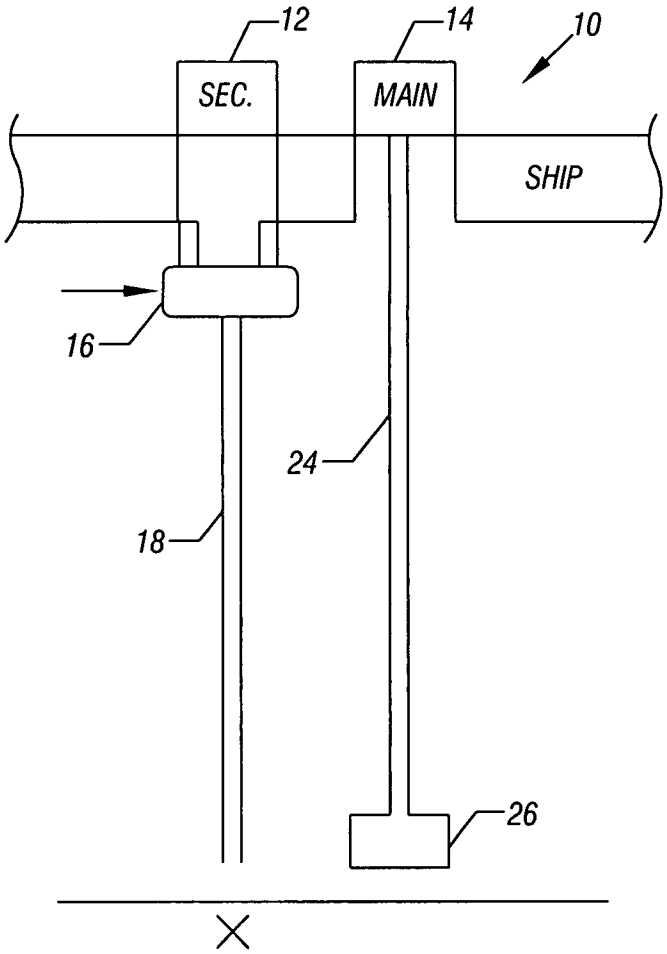
FIG. 4 is a partial, schematic depiction of the drill ship shown in FIG. 1 at a subsequent stage of well completion in accordance with one embodiment of the present invention.

At the same time, in the main drilling center 14, a marine riser 24 may be assembled with the blowout preventer 26 secured to its lowermost end as indicated in FIG. 1. Thus, the blowout preventer 26 has already been skidded, tested, and assembled. Depending on the depth of the sea S, the blowout preventer 26 may be all the way down to a position close to the seabed floor, as shown in FIG. 4, or it may still be suspended within the sea S, well above the seabed floor, at the time that drilling operations are ready to begin, the ship has been accurately positioned.

In some embodiments, the blowout preventer 26 may be lowered to the position shown in FIG. 3, but, in other embodiments, the blowout preventer may not yet have reached a point proximate to the seabed floor at the time the conductor 22 is jetted in. This positioning of the blowout preventer may depend on how skillful the crew is, how long it takes to position the ship, and the depth of water in which the ship is operating among other factors.

Note that at the point in time shown in FIG. 2, no contact with the seabed SB has yet been made in some embodiments. This lack of contact enables the ship to be repositioned in the course of the ship positioning operation. Prior to completion of dynamic positioning, the 20 inch conductor may be made up on the secondary drilling center 12 and transferred to and hung off of the trolley 16. Also, the conductor 22 may be already made up and lowered down to, but not touching, the seabed.

While the casing 18 is made up on the secondary drilling center 12, transferred to the trolley 16, and the conductor 22 is made up and lowered from the secondary drilling center 12, the marine riser 24 and blowout preventer 26 may be assembled and may be begun to be run to the seabed S from the main drilling center 14. Thus, it will be appreciated that three different tubulars may be assembled, at least partially in parallel, and partially pre-positioned and preassembled prior to the time that drilling operations can actually begin because the ship is accurately positioned.

Once the ship is accurately positioned, the running of the blow out preventer and riser may be stopped. Then, the 30 inch conductor 22 may be lowered into contact with the seabed floor SB as shown in FIG. 3. Then, the 30 inch conductor 22 may be jetted into the seabed in one embodiment. Thereafter, an internal 26 inch drill, within the string 18, may be operated to drill a 26 inch hole. Of course, these sizes of the tubulars and the holes that are drilled are simply illustrative. Other tubular sizes and hole sizes may be utilized and those skilled in the art will appreciate that only examples are given herein.

After completion of the 30 inch jet in and the 26 inch hole drilling, the 30 inch conductor 22 and its tubulars 20 may be raised from the secondary drilling center 12, disassembled, and stored.

Once the 30 inch conductor is no longer touching the seabed, then the running of the blow out preventer and riser may be resumed.

As soon as the 30 inch conductor 22 is out of the way, the trolley 16 may be rolled to the right to the position shown in FIG. 4 with the 20 inch casing 18 already fully or at least partially assembled thereunder. The 20 inch casing 18 may then be connected to the secondary drilling center 12 using a running tool or another tool of the type shown in FIG. 8. The 20 inch casing may then be run into the 26 inch hole and cemented in place.

At the times shown in FIG. 4 after the 30 conductor 22 is placed onto the seabed floor SB and jetted in, the riser 24 and blowout preventer 26 may be continued to be run into the seabed S. In other words, in embodiments where it was not possible to get the blowout preventer 26 proximate to the seabed floor at the point in time when drilling operations can begin, the downward course of the riser 24 and blowout preventer 26 may be continued thereafter, as possible. Specifically, that downward running of the blowout preventer 26 may be continued while the 30 inch conductor is being jetted in, the 26 inch hole is being drilled, and the 20 inch casing 18 is transferred to the trolley to the secondary drilling center 12 and then run into the seabed and cemented in.

Thus, operations in the main drilling center 14 with the blowout preventer 26 continue, to the extent necessary and as possible, while other operations are occurring so as to further reduce the overall time of the drilling operation.

In some embodiments, the riser 24 and blowout preventer 26 may be maintained out of contact with the seabed floor at any time when the 20 inch casing 18 is in contact with the seabed floor. Thus, once the 20 inch casing makes contact with the seabed floor, in those embodiments, the blowout preventer 26 is at all times out of contact with the seabed floor and may not be run in some embodiments.

Figure 6:
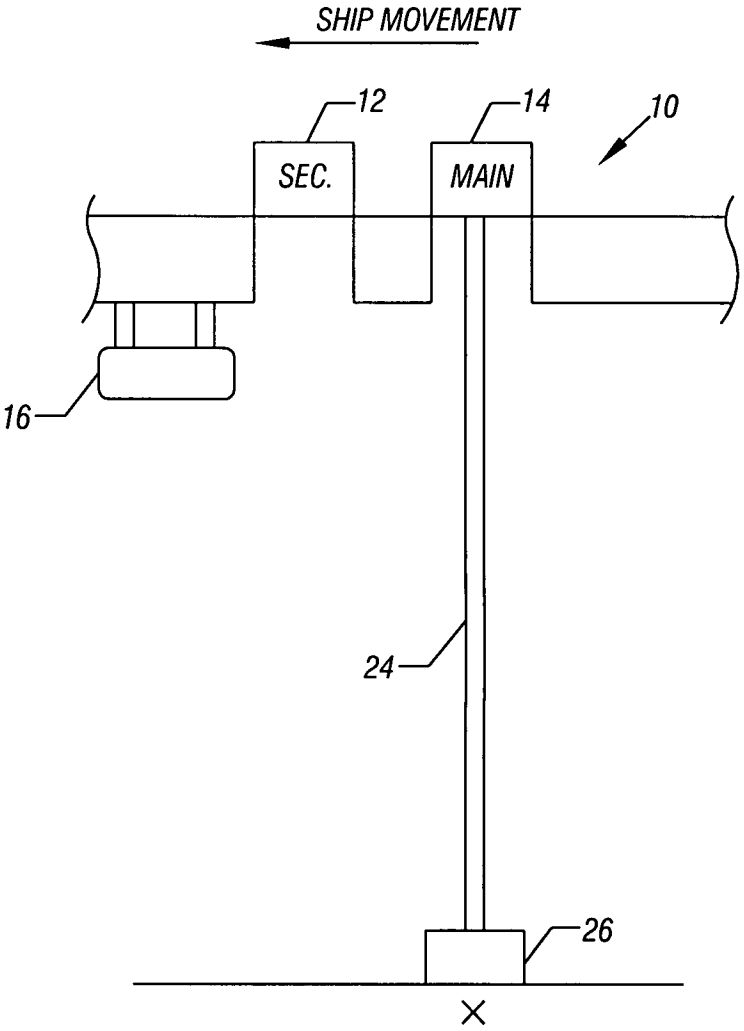
FIG. 6 is a depiction of the same drill ship after the ship has been moved in accordance with one embodiment of the present invention.
Figure 5:
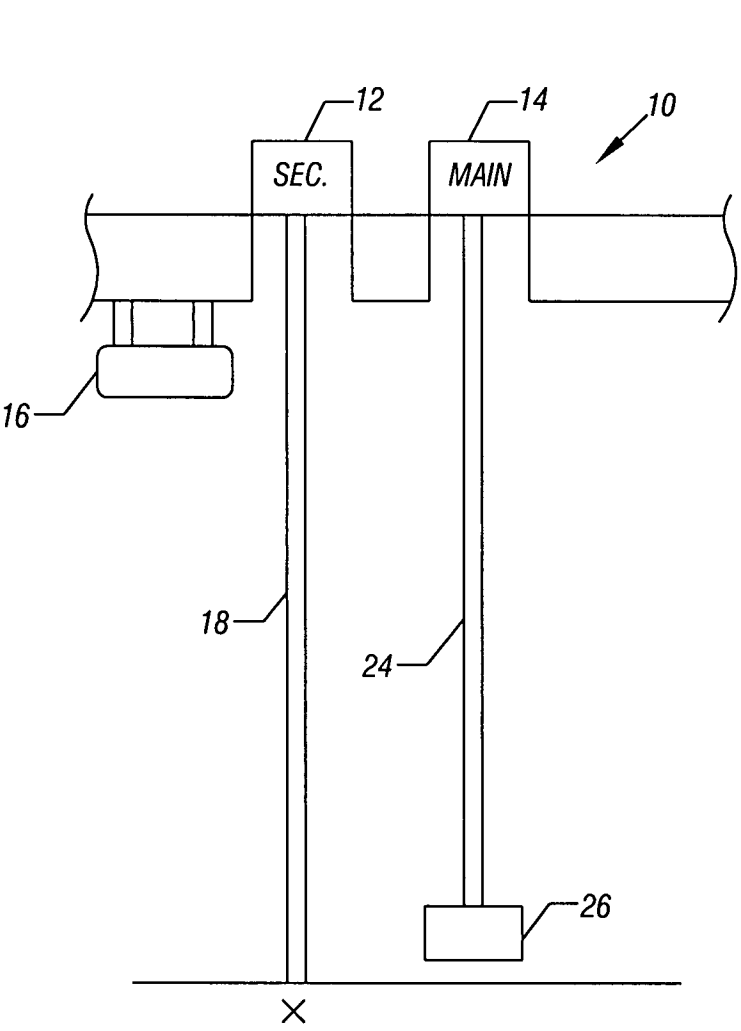
FIG. 5 is a partial, schematic depiction of the drill ship shown in FIG. 1 at a subsequent stage of well completion in accordance with one embodiment of the present invention.

Once the 20 inch casing is in place, the tubulars 18 may be released from the seabed, withdrawn, disassembled, and stored, so that the ship 10 may be repositioned. Particularly, the ship may be repositioned in the direction of the arrows shown in FIG. 6. In some embodiments, it is advantageous to have the trolley 16, and the drilling centers 12 and 14 aligned along the length of the ship so that the ship may be moved in a normal forward motion direction to reposition the blowout preventer 26 and the riser 24 over the well as indicated in FIG. 6. Thus, longitudinal conventional forward power may be utilized to reposition the ship and the riser and blowout preventer over the well.

Once the ship has been positioned accurately, the blowout preventer may be latched on the 20 inch casing already in position. Then, a 17½ inch hole is drilled and the 13⅜ inch casing may be run and cemented in position. The 13⅜ inch casing may be assembled on a pipe racker in some embodiments.

In some embodiments, this results in completion of the well. If subsequent drilling operations are desired, the ship may be repositioned after detaching the riser. For example, in some cases, the ship may be repositioned with the risers still hanging from the ship, as long as the repositioning distance is relatively short. However, in other embodiments, the entire process begins again.

In the case where production is planned, then the ship can be maintained in position and production may begin.

Figure 7:
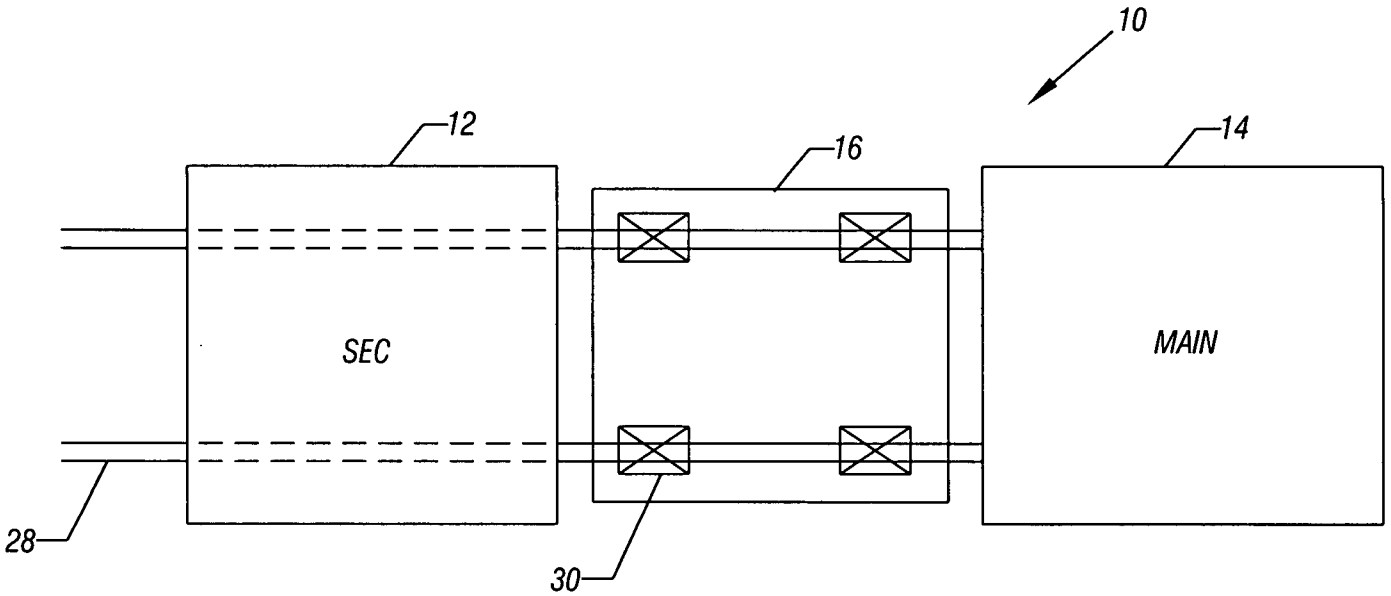
FIG. 7 is a partial, schematic, enlarged top plan view of the ship shown in FIG. 4 in accordance with one embodiment of the present invention.

Referring to FIG. 7, in some embodiments of the present invention, the trolley 16 may be mounted on a pair of parallel tracks 28 which extend under the secondary drilling center 12 and to the left thereof. In one embodiment, the trolley 16 may be a conventional Christmas tree trolley which hangs from rollers 30 positioned over the track 28. However, other arrangements are also possible.

References throughout this specification to "one embodiment" or "an embodiment" mean that a particular feature, structure, or characteristic described in connection with the embodiment is included in at least one implementation encompassed within the present invention. Thus, appearances of the phrase "one embodiment" or "in an embodiment" are not necessarily referring to the same embodiment. Furthermore, the particular features, structures, or characteristics may be instituted in other suitable forms other than the particular embodiment illustrated and all such forms may be encompassed within the claims of the present application.

While the present invention has been described with respect to a limited number of embodiments, those skilled in the art will appreciate numerous modifications and variations therefrom. It is intended that the appended claims cover all such modifications and variations as fall within the true spirit and scope of this present invention.

What is claimed is:

1. A method comprising:

running a marine riser and blowout preventer from a first station of a ship into the sea;

running a conductor from a second station on the ship into the sea while the marine riser and blowout preventer are being run; and refraining from running said marine riser and blowout preventer when said conductor is in contact with the seabed.

2. The method of claim 1 including assembling tubulars on the ship while the ship is en route to a drilling site.

3. The method of claim 2 including assembling said blowout preventer and riser before completing dynamic positioning of said ship.

4. The method of claim 1 including using a trolley to move assembled tubulars.

5. The method of claim 4 including using a first and second tubular handling center.

6. The method of claim 5 including moving said trolley from a first position under said first tubular handling center to a second position out from under said first tubular handling center.

7. The method of claim 6 including drilling from said second tubular handling center.

8. The method of claim 4 including assembling a casing on said second tubular handling center, transferring said casing to said trolley, and moving said casing from said second tubular handling center.

9. The method of claim 8 including, after transferring said casing, assembling tubulars including said conductor on said second tubular handling center.

* * * * *